US006950527B2

(12) United States Patent
Chu

(10) Patent No.: US 6,950,527 B2
(45) Date of Patent: Sep. 27, 2005

(54) CIRCUIT AND METHOD OF 3-WIRED INTERFACE FOR HEADPHONES

(75) Inventor: Wei-shang Chu, San Jose, CA (US)

(73) Assignee: Via Technologies, Inc., Taipei (TW)

( * ) Notice: Subject to any disclaimer, the term of this patent is extended or adjusted under 35 U.S.C. 154(b) by 260 days.

(21) Appl. No.: 10/284,103

(22) Filed: Oct. 31, 2002

(65) Prior Publication Data

US 2004/0086139 A1 May 6, 2004

(51) Int. Cl.[7] ..... H04R 1/10

(52) U.S. Cl. ..... 381/74; 381/111

(58) Field of Search ..... 381/74, 309, 111; 700/94; 455/344, 350

(56) References Cited

U.S. PATENT DOCUMENTS 5,175,768 A * 12/1992 Daniels ..... 381/309

* cited by examiner

*Primary Examiner*—Ping Lee
(74) *Attorney, Agent, or Firm*—Rabin & Berdo, P.C.

(57) ABSTRACT

A circuit for coding input signals to an audio output device. The circuit comprises a first coder generating voice signals on a first and second channel, and a second coder receiving the voice signals of the first and second channel, and outputting a first, second and reference voltage signal to the audio output device, wherein the reference voltage signal switches between a first and second voltage level, and the voice signals of the first and second channel are represented by differential signals of the first and reference voltage signal, and the second and the reference voltage signal, respectively.

12 Claims, 3 Drawing Sheets

CIRCUIT AND METHOD OF 3-WIRED INTERFACE FOR HEADPHONES

BACKGROUND OF THE INVENTION

1. Field of the Invention

The present invention relates to a circuit and method for coding input signals from an audio output device, particularly to a circuit and method for coding input signals to a 3-wired interface for a pair of stereo differential pulse coded headphones.

2. Description of the Prior Art

FIG. 1 is a diagram showing a pair of conventional analog 3-wired headphones 11, with a right and left speakers 121, 122. Each of the speakers 121, 122 gives off sound by a differential voltage signal from the terminal A and B, or C and D. The headphones 11 have three input terminals 111, 112 and 113 for receiving the external analog voice signal. Both terminals B and D are connected to the same input terminal 112 to share a common ground reference voltage, while the terminals A and C are connected to the input terminals 111 and 113 respectively. Wherein the terminal 111 receive an analog voice signal VSR from a right channel and the terminal 113 receive an analog voice signal VSL on from left channel for generating the stereo sound.

However, the conventional analog 3-wired headphones demand high power consumption due to the analog input voice signals.

FIG. 2 is a diagram showing a 4-wired headphone 21 with a right and left speaker 221 and 222. Each of the speakers 221 and 222 gives off sound by a differential voltage signal from the terminal A and B, or C and D. The headphone 21 has four input terminals 211, 212, 213 and 214. The terminals B and D are connected to the input terminal 212 and 213 respectively to receive their corresponding reference voltages respectively, while the terminals A and C are connected to the input terminal 211 and 214 respectively to receive an analog voice signal VSR on a right channel and an analog voice signal VSL on a left channel for generating the stereo sound. There are two differential input pairs in the 4-wired headphones.

However, the 4-wired headphones are not compatible with most existing audio headphone systems with 3-wired plugs.

SUMMARY OF THE INVENTION

Therefore, the object of the present invention is to provide a circuit and method for coding input signals of a 3-wired interface of a stereo differential pulse coded headphone, wherein one of the advantages of the present invention is low power consumption due to the digital input signals.

The present invention provides a circuit for coding input signals in an audio output device, such as the stereo headphone. The circuit comprises a first coder generating voice signals on a first and second channel, and a second coder receiving the voice signals of the first and second channel, and outputting a first, second and reference voltage signal to the audio output device, wherein the reference voltage signal switches between a first and second voltage level, and the voice signals of the first and second channel are represented by differential signals of the first and reference voltage signal, and the second and the reference voltage signal, respectively.

The present invention further provides a method for coding input signals to an audio output device. The method comprises the steps of generating voice signals on a first and second channel; and receiving the voice signals of the first and second channel, and outputting a first, second and reference voltage signal to the audio output device, wherein the reference voltage signal switches between a first and second voltage level, and the voice signals of the first and second channel are represented by differential signals of the first and reference voltage signal, and the second and the reference voltage signal, respectively.

Thus, by providing a variable reference voltage signal or a virtual ground, digital input signals are used in the 3-wired headphones. This results in an audio system with lower power consumption than that of the conventional system and compatible with existing 3-wired headphones.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

Figure 1:
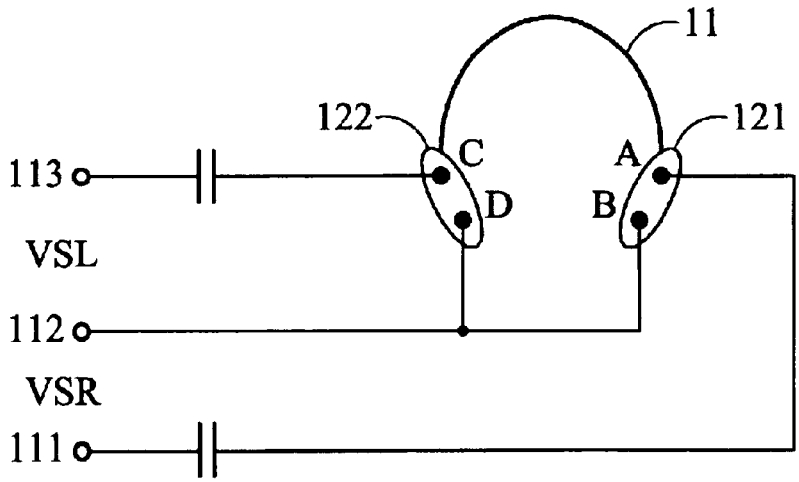
FIG. 1 ( PRIOR ART )
FIG. 1 is a diagram showing a conventional analog 3-wired headphone.
Figure 2:
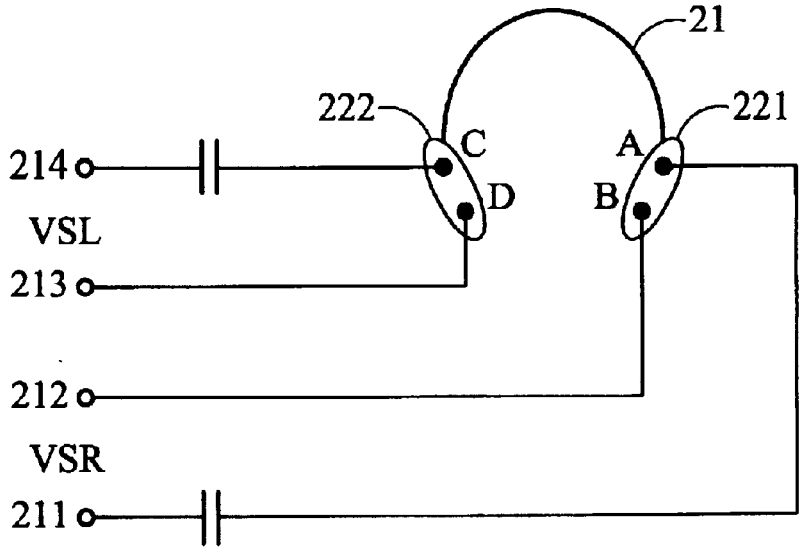
FIG. 2 ( PRIOR ART )
FIG. 2 is a diagram showing a conventional 4-wired headphone.
Figure 3:
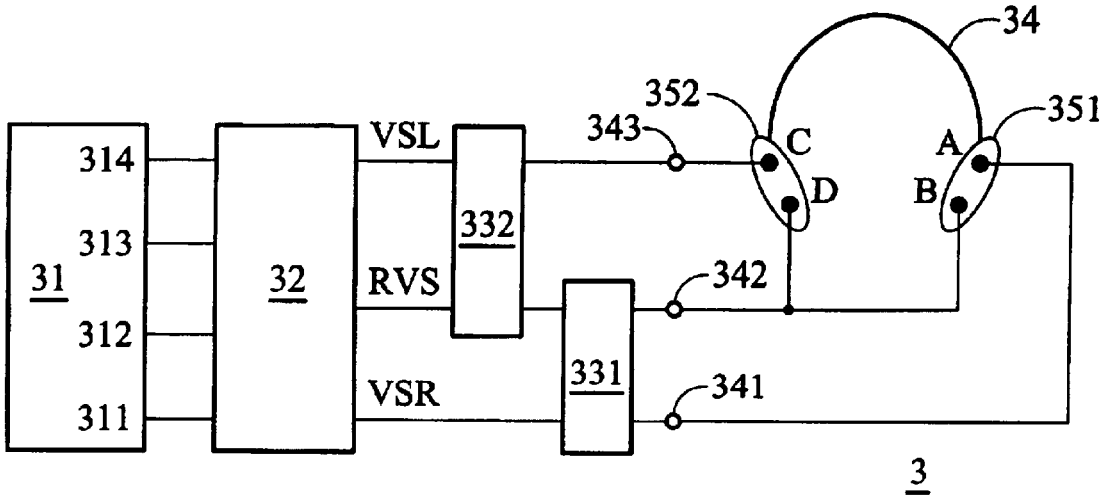
FIG. 3 is a diagram showing a 3-wired headphones according to one embodiment of the present invention.

FIG. 3 is a diagram showing a 3-wired headphone according to one embodiment of the present invention. A circuit 3 for coding input signals of the 3-wired headphone 34 comprises a waveform coder 31 for generating voice signals of a right and left channel of stereo sound, and a 3-way coder 32 receiving the voice signals of the right and left channel, and outputting signals VSR, RVS and VSL to the 3-wired headphones 34, a filter 331 for receiving and filtering the signals VSR and RVS, and a filter 332 receiving and filtering the signals VSL and RVS. The wave form coder 31 outputs the voice signals on the right and left channel by four output terminals 311, 312, 313 and 314. The voice signal on the right channel is a differential signal between the output terminals 311 and 312 while the voice signal on the left channel is a differential signal between the output terminals 313 and 314.

The headphones 34 have a right and left speaker 351 and 352. Each of the speakers 351 and 352 gives off sound by a differential voltage signal from the terminal A and B, or C and D, the driver has good power efficiency than the prior art while the state of the differential voltage signal is 0 (i.e. off). The U.S. patent application Ser. No. 2002/0075068 mentioned a kind of quaternary coding provided quaternary level(1, OH, −1 and OL) which can be used in the present invention to reduce the driver consumption. The headphones 34 have three input terminals 341, 342 and 343. Both from the terminals B and D are connected to the input terminal 342 to share the filtered reference voltage signal RVS, while the terminals A and C are respectively connected to receive the filtered signal VSR and VSL.

Figure 4:
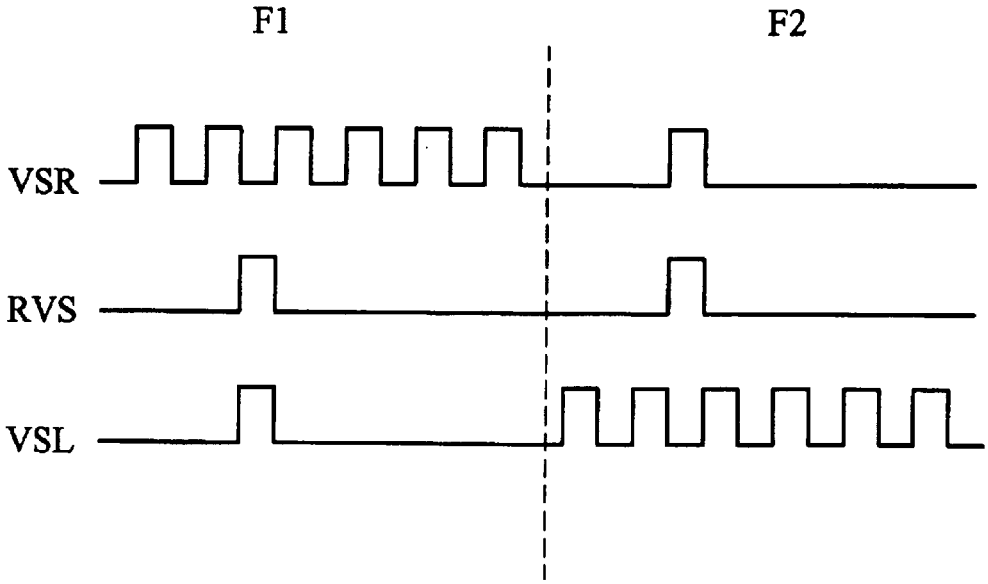
FIG. 4 is a diagram showing signals waveforms of the 3-wired headphone according to one embodiment of the present invention.

FIG. 4 is a diagram showing a timing diagram of signals VSR, VSL and RVS. The signal RVS for providing a reference voltage which is not a constant DC signal but switches between a high and low voltage level. During a phase F1 (or call "Slot 1"), the signal VSL follows the reference voltage signal RVS so that there is no voltage difference between them and the differential signal is kept at a zero voltage level. That is to say, there is no voice signal on the left channel transmitted to the headphones 34 and only the voice signal on the right channel, the differential voltage signal of the signals VSR and RVS, is transmitted during the phase F1. During a next phase F2(or call "Slot 1"), the signal VSR follows the reference voltage signal RVS so that there is no voltage difference between them and the differential signal is kept at a zero voltage level. That is to say, there is no voice signal on the right channel transmitted to the headphones 34 and only the voice signal on the left channel, the differential voltage signal of the signals VSL and RVS, is transmitted during the phase F2. The speakers 351 and 352 receive the voice signals of the right and left channel in turn. This will not affect the sound quality if a switching rate of the phase F1 and F2 is high enough.

Figure 5:
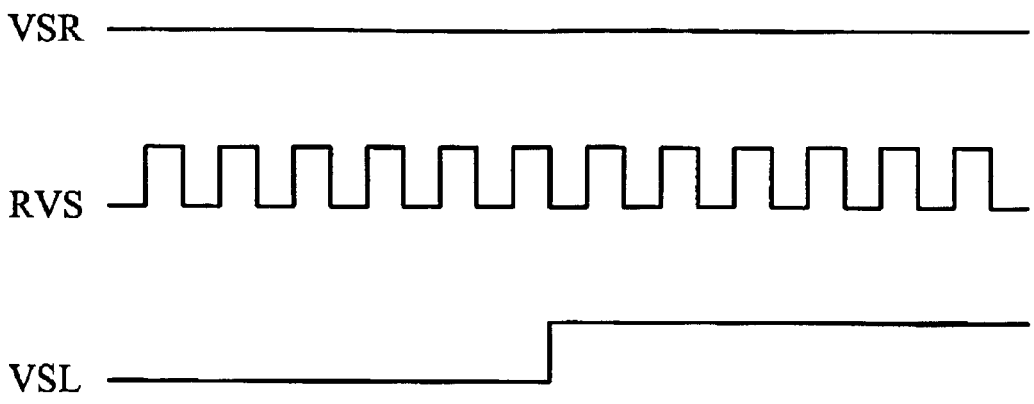
FIG. 5 is a diagram showing signals waveforms of the 3-wired headphone according to one embodiment of the present invention.

Alternatively, FIG. 5 is a diagram showing another timing of the signals VSR, VSL and RVS. The signal RVS for providing the reference voltage is not a DC signal but periodically switches between a high and low voltage level. The signal RVS acts as a virtual ground. The voice signals of the right and left channel (the differential voltage signals of the signals VSR and RVS, and VSL and RVS) are transmitted to the headphones 34 simultaneously. Neither phase F1 nor F2 is needed.

Figure 6:
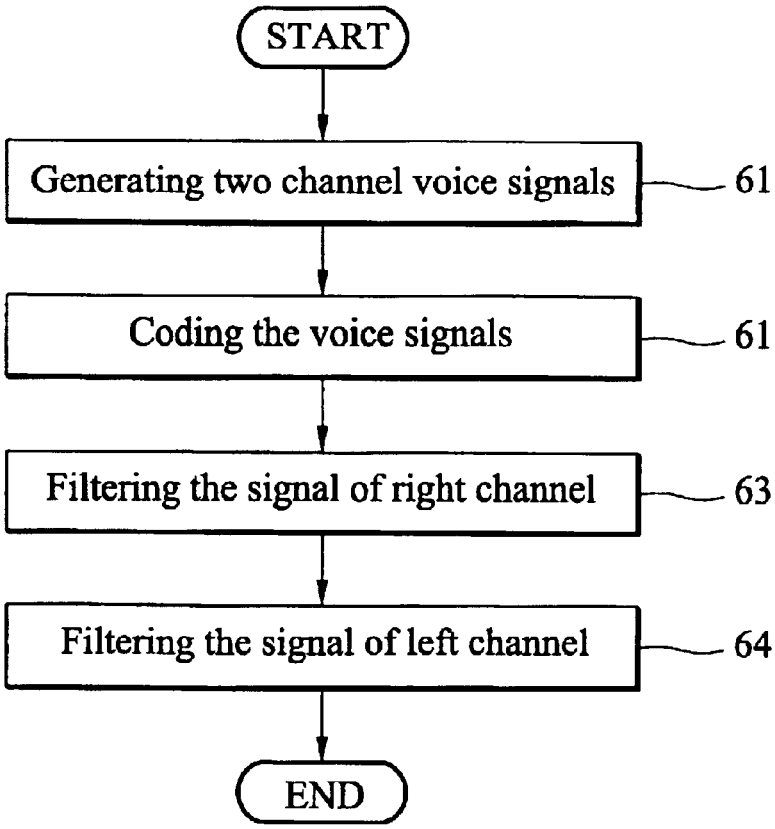
FIG. 6 is a flowchart of the method for coding input signals and outputting the coded signals to an audio output device according to one embodiment of the present invention.

FIG. 6 is a flowchart of a method for coding input signals to an audio output device (3-wired headphones) according to one embodiment of the invention.

In step 61, voice signals on a right and left channel for stereo sound are generated.

In step 62, the voice signals of the right and left channel are received and coded. After coding, a first, second and reference voltage signal are output to 3-wired headphones. The reference voltage signal switches between a high and low voltage level, and the voice signals of the right and left channel are represented by differential signals of the first and reference voltage signal, and the second and the reference voltage signal, respectively.

In step 63, the first and reference voltage signal are received and filtered.

In step 64, the second and reference voltage signal are received and filtered.

In the previously described method, the second signal follows the reference voltage signal and the differential signal therebetween is kept at a zero voltage level during a first phase, and the first signal follows the reference voltage signal and the differential signal therebetween is kept at the zero voltage level during a second phase. The headphones receive the voice signal of the right and left channel in turn. This will not affect the sound quality if a switching rate of the phase F1 and F2 is high enough.

Alternatively, the reference voltage signal switches between the high and low voltage level periodically. The differential voltage signals of the first and reference voltage signal, and the second and reference voltage signal, are transmitted to the headphones simultaneously.

In conclusion, the present invention provides a circuit and method for coding input signals of a 3-wired interface for a pair of stereo differential pulse coded headphones. By providing a variable reference voltage signal or a virtual ground, digital input signals are used in the 3-wired headphones. This results in an audio system with lower power consumption than that of the conventional system and compatible with existing 3-wired headphones.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A circuit for coding audio input signals and output to an audio output device for connecting a 3-wired headphone, the circuit comprising:

a first coder for generating voice signals for a first channel, second channel, and a common channel; and a second coder for receiving the voice signals from the first channel and second channel, and outputting a first, a second and a reference voltage signal to the audio output device, wherein the reference voltage signal switches between a first and second voltage level, and the voice signals of the first channel and second channel are represented by differential signals of the first and reference voltage signal, and the second and the reference voltage signal, respectively.

2. The circuit as claimed in claim 1, wherein the audio output device is a 3-wired headphone.

3. The circuit as claimed in claim 1, wherein the first and second channels are a right and left channel of stereo sound.

4. The circuit as claimed in claim 1 further comprising:

a first filter for receiving and filtering the first voltage signal and reference voltage signal; and a second filter for receiving and filtering the second voltage signal and reference voltage signal.

5. The circuit as claimed in claim 1, wherein the voltage levels of the second signal and the reference voltage signal are identical during a first phase, thereby keeping the corresponding differential signal at a zero voltage level, and the voltage levels of the first signal and the reference voltage signal are identical during a first phase, thereby keeping the corresponding differential signal at the zero voltage level.

6. The circuit as claimed in claim 1, wherein the reference voltage signal switches between the first and second voltage level periodically.

7. A method for coding input signals to an audio output device, the method comprising the steps of:

generating voice signals on a first and second channel; and receiving the voice signals of the first and second channel, and outputting a first, second and reference voltage signal to the audio output device, wherein the reference voltage signal switches between a first and second voltage level, and the voice signals of the first and second channel are represented by differential signals of the first and reference voltage signal, and the second and the reference voltage signal, respectively.

8. The method as claimed in claim 7, wherein the audio output device is a pair of 3-wired headphones.

9. The method as claimed in claim 7, wherein the first and second channel are the right and left channels of stereo sound.

10. The method as claimed in claim 7, further comprising the steps of:

receiving and filtering the first and reference voltage signal; and receiving and filtering the second and reference voltage signal.

11. The method as claimed in claim 7, wherein the voltage levels of the second signal and the reference voltage signal are identical during a first phase, thereby keeping the corresponding differential signal at a zero voltage level, and the voltage levels of the first signal and the reference voltage signal are identical during a first phase, thereby keeping the corresponding differential signal at the zero voltage level.

12. The method as claimed in claim 7, wherein the reference voltage signal switches between the first and second voltage level periodically.

* * * * *